US008737174B2

(12) United States Patent
Hoover

(10) Patent No.: US 8,737,174 B2
(45) Date of Patent: May 27, 2014

(54) INERTIAL MOTION OF A MECHANICAL DISPLAY MEMBER

(75) Inventor: David Hoover, La Sarraz (CH)

(73) Assignee: The Swatch Group Research and Development Ltd, Marin (CH)

( * ) Notice: Subject to any disclaimer, the term of this patent is extended or adjusted under 35 U.S.C. 154(b) by 129 days.

(21) Appl. No.: 13/314,433

(22) Filed: Dec. 8, 2011

(65) Prior Publication Data

US 2012/0155223 A1 Jun. 21, 2012

(30) Foreign Application Priority Data

Dec. 16, 2010 (EP) ..... 10195412

(51) Int. Cl.
*G04B 27/00* (2006.01)

(52) U.S. Cl.
USPC ..... 368/69; 368/80; 368/187

(58) Field of Classification Search
USPC ..... 368/69, 187, 80
See application file for complete search history.

(56) References Cited

U.S. PATENT DOCUMENTS

| | | | | |
|---|---|---|---|---|
| 4,261,048 | A | 4/1981 | Motoki et al. | |
| 4,358,837 | A * | 11/1982 | Yamazaki et al. | 368/69 |
| 4,445,785 | A * | 5/1984 | Chambon et al. | 368/187 |
| 4,470,707 | A | 9/1984 | Chambon et al. | |
| 4,912,692 | A * | 3/1990 | Kamens | 368/157 |
| 6,161,957 | A * | 12/2000 | Guanter | 368/185 |
| 2004/0042347 | A1 * | 3/2004 | Born et al. | 368/69 |
| 2004/0222760 | A1 * | 11/2004 | Nireki et al. | 318/362 |
| 2007/0238519 | A1 * | 10/2007 | Suzuki | 463/22 |

FOREIGN PATENT DOCUMENTS

| | | | |
|---|---|---|---|
| CH | 641 630 | A5 | 3/1984 |
| EP | 0 361 015 | A2 | 4/1990 |
| GB | 2 019 049 | A | 10/1979 |

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

Coupling device 3 between activation means 1 and mechanical display means 2 of a display mechanism, wherein the coupling device 3 is adapted to apply a motion to said mechanical display means 2, in response to activation of the activation means, wherein the motion applied to the mechanical display means 2 is inertial.

14 Claims, 2 Drawing Sheets

S1
S2
1
11
2
21
22
3
31
4
44
5
6
7
61
62
111
401
4001
5000
700
704x703'=401'-703"
5001
5002
611,622
211,222

INERTIAL MOTION OF A MECHANICAL DISPLAY MEMBER

This application claims priority from European Patent Application No. EP10195412.1 filed Dec. 16, 2010, the entire disclosure of which is incorporated herein by reference.

The present invention relates to the field of analogue display devices. It concerns, more specifically, timepieces provided with a display achieved using mechanical members.

In mechanical timepieces, in particular wristwatches with hands, time-setting devices are known that are activated by a crown, kinematically connected to the motion work of the watch in the axial position thereof corresponding to the time-setting mode, with determined gear ratios for moving the minute hand simply and quickly without having to rotate the crown for too long or too often.

In electronic timepieces with a digital display, in particular a liquid crystal display, it is known to accelerate the scrolling velocity of the digital symbols by the prolonged or repeated activation of a sensor when the timepiece is in a specific adjustment or setting mode. For example, a prolonged application of pressure to the push button accelerates scrolling to a maximum velocity value for the display value to be corrected. The adjustment is then performed sequentially for each display parameter.

Digital display correction devices are also known which use a crown provided with sensors as an activation element, and an electronic coupling device for correction at a velocity which is a function of the rotational velocity of the crown, like for example, the electronic circuit disclosed in GB Patent No. 2019049. In this case, the correction speeds are constant between different plateaux corresponding to rotational speeds of the crown, but they may however change suddenly upon each increment. Moreover, no correction occurs between two successive movements of the crown, and no mechanism is provided for slowing down the scrolling of the counter used for correction. Thus, a fine adjustment requires repeated low amplitude activations by the user, to generate the lowest possible correction velocity. On the one hand this is inconvenient, and on the other hand it does not overcome the jerky movement of the hands.

CH Patent No. 641630 discloses an electronic device for scrolling through symbols at a variable velocity in response to the activation of a sensor (by moving a finger on a tactile sensor, pressure on a push button). The number of activations of the sensors and the duration of these activations have the effect of incrementing or decrementing the values contained in a register, which in turn determine a proportional scrolling speed. Decrementing the values in the register after prolonged inactivation of the sensors gradually decreases the scrolling speed. However, this slowing down of the scrolling speed still lacks fluidity since the relative variations in the scrolling speed increase as the register values come closer to zero. This solution has the advantage of using sensors without any mechanical parts. The drawback is that they are less intuitive to use than a conventional crown. Moreover, this solution only concerns digital displays and does not apply to watches with analogue display members.

Consequently, it is an object of the present invention to propose a solution that is free of the aforementioned drawbacks of the prior art.

In particular, it is an object of the present invention to propose a correction device and method which are quicker and more intuitive for the user while maintaining the approach of a totally mechanical solution.

These objects are achieved by a coupling device between the activation means and the mechanical display means of a display mechanism, which is adapted to apply a motion of variable velocity to said mechanical display means, in response to the activation of said activation means, and wherein it generates an inertial motion of the mechanical display means, i.e. wherein deceleration is proportional to velocity once the activation means are no longer activated.

These objects are also achieved by a method for adjusting or setting the display parameters visualised using mechanical display means that can be activated by activation means, including a step of activating the activation means to apply a motion of variable velocity to the mechanical display means, characterized by the following sequence of steps after the activating step:

A phase of accelerating the mechanical display means.

An inertial deceleration phase of said mechanical display means following inactivation of the control means for a given period of time.

One advantage of the proposed solution is that it improves the rapidity and convenience of adjustment by uncoupling the velocities of the control members and the mechanical display members, which makes it possible to adjust the velocity of motion to the range of correction to be performed. This makes the adjustment operation more efficient on the one hand, and more visually intuitive on the other hand, by emulating an inertial motion of the analogue display means, i.e. which is performed with deceleration proportional to the velocity of the display means, once activation of the activating means has stopped. It is therefore possible, first of all, to perform a rough adjustment and then a finer adjustment, when close to the desired value, at a continuous velocity.

Another advantage of the proposed solution is that it minimises the manipulations necessary for adjustment, since only a few sporadic activations of the control member are necessary to adjust the position of the display members. Moreover, control of the adjustment operations is improved, since it is possible to act not only to accelerate the correction velocity but also to decelerate said velocity.

An additional advantage of the proposed solution is that it allows simultaneous adjustment of several display parameters, unlike the usual sequential adjustments for electronic watches. The time saved by the invention for correction by the continuous motion of the display means between periods of activation of the activation means gives the option of moving, for example the hour and minute hands, at the same time, in the intuitive approach of a conventional mechanical watch, without a large correction taking too long in the user's view.

Finally, according to a preferred embodiment described hereinafter, the proposed solution does not require any particular resolution of sensors for incrementing the display values. Fluidity of adjustment is ensured in particular by the fact that this it is not a correction velocity that is deduced from the control member movements, or detected by a sensor, but the acceleration of the display member. This thus generates a continuous velocity of the display member, in conformity with the motion of a mechanical member according to Newton's laws of physics. This velocity has only small variations between different control member activation periods, and consequently the proposed solution is not subject to any threshold effect on the sensor resulting in jerky movements of the display members.

Other features and advantages will appear more clearly in the detailed description of various embodiments and the annexed drawings, in which.

The present invention concerns a coupling device between two parts, at least one of which is mechanical and the other is either mechanical or connected to a sensor. The coupling device creates a relation of interdependence for the mutual operation of these parts and it is therefore possible to generate motion of one part, unilaterally or bilaterally, from motion of the other. The invention concerns both a coupling device including electronic elements, and a totally mechanical coupling device, i.e. free of any electronic circuits. Although the preferred variant of the invention disclosed hereinafter with reference to the Figures uses a microcontroller for simulating and implementing the desired inertia effect for moving analogue display means, it is entirely possible to envisage forming a kinematic connection between the activation means, in the form of a mechanical control member and the display means, such as typically a crown and hands within a conventional timepiece. For example, a free wheel kinematic connection may be obtained by using a reverser wheel, one pinion of which is in mesh with a gear train activated by the crown, whereas the other pinion is integral with a massive disc on which the minute hand is fixed, the hour hand then being activated via a conventional motion work. In this configuration, the massive disc rotates like a free wheel about its axis of rotation and that of the pinion integral therewith, as soon as the crown is no longer activated, and the friction forces gradually decrease the rotational velocity of the disc and thus that of the minute hand as soon as the crown is no longer being activated.

Figures 1A, 1B:
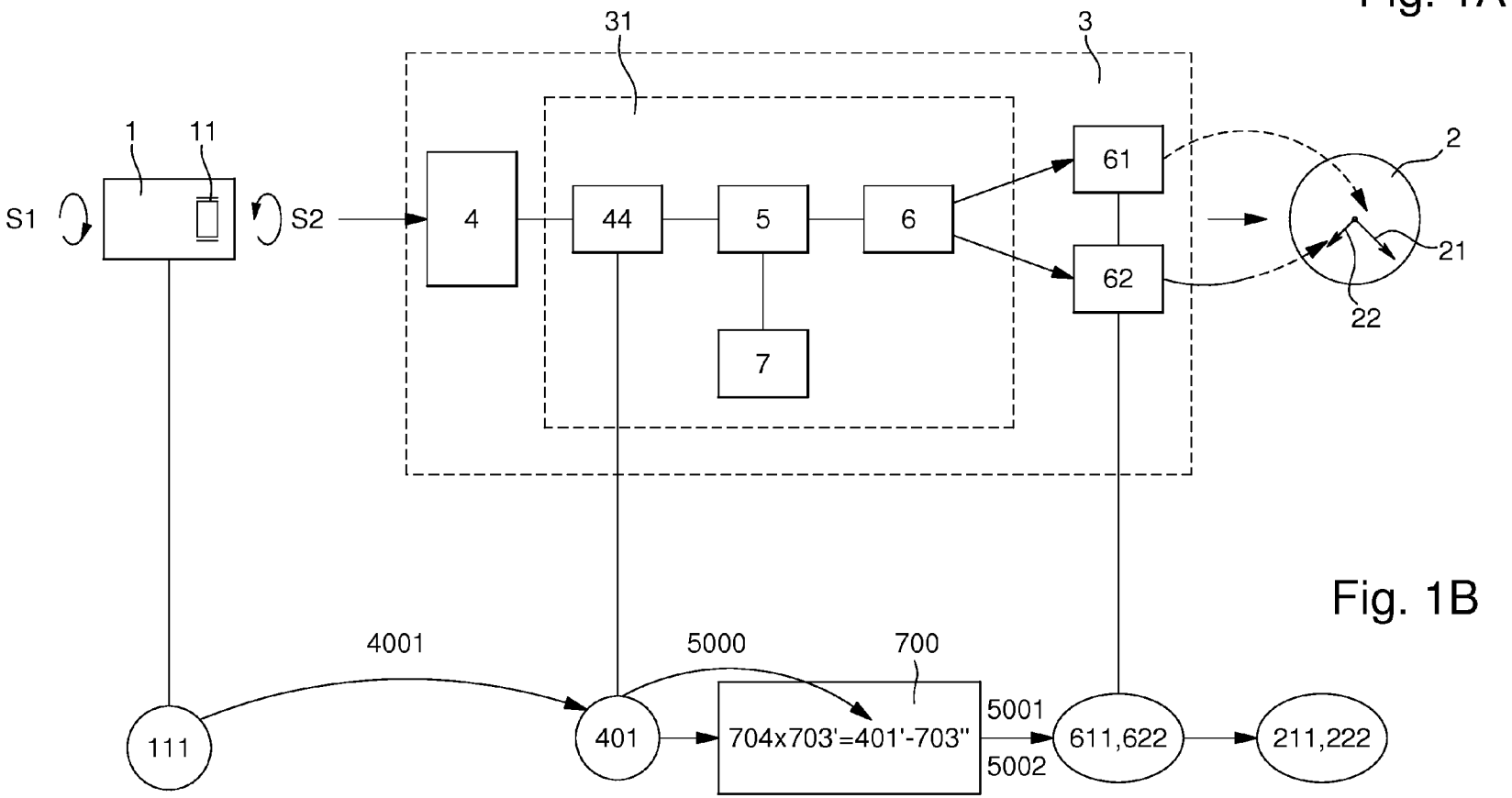
FIG. 1A shows a schematic view of the coupling device according to a preferred embodiment of the invention.
FIG. 1B shows the various parameters used and the various calculation steps performed by different elements of the coupling device according to the preferred embodiment illustrated in FIG. 1A.

A preferred embodiment of the coupling device of the invention is intended for timepieces and is illustrated in FIGS. 1A and 1B, which respectively show the logical structure of coupling device 3 and the different parameters used and the different calculation steps performed by various elements of coupling device 3 to convert the motion of control means 1 into a non proportional motion of the display means, unlike a conventional mechanical gear train. FIG. 1A shows the preferred structure of activation means 1 in the form of a crown 11, which can be activated in two opposite directions of rotation S1 and S2, and that of display means 2 in the form of an hour hand 22 and minute hand 21. However, coupling device 3 according to the invention could be applied to other types of mechanical display members 2, such as for example rings or drums. The invention consequently enables a first angular velocity 111, namely the driving velocity of crown 11 in a given direction of rotation, for example S1, to be converted into another angular velocity 211 of minute hand 21. The two angular velocities 111 and 211 are not proportional, since minute hand 211 is gradually accelerated following activation of the crown 11 in direction S1 according to Newton's equation of motion 700 described hereinafter, which makes the motion of the hands continuous.

Coupling device 3 according to the preferred variant of the invention illustrated in FIG. 1A includes an electronic circuit 31 preferably taking the form of an integrated circuit including a processing unit 5, for example including a microcontroller, and a motor control circuit 6. The microcontroller converts the digital input parameters, supplied by a counter module 44 at the output of a motion sensor 4 of activation means 1, i.e. for example the rotation of crown 11, into data for motor control circuit 6, such as for example a number of motor steps. Counter module 44 converts the electric signals produced by sensor 4 into discrete numeric values, which can be handled by a software processing unit such as the microcontroller. The latter is however not described in detail since it is known to those skilled in the art. According to the preferred variant illustrated, the control circuit 6 controls two distinct motors, wherein a first motor 61 is dedicated to controlling the movements of minute hand 21, and a second motor 62 is dedicated to the control of the hour hand 22. Coupling device 3 thus simultaneously activates a plurality of motors 61, 62 each dedicated to distinct mechanical display means. The disassociation of the motors allows the display mode to change quickly, for example indicating an alarm time or the direction of a terrestrial magnetic field.

To perform calculations, the microcontroller uses different parameters saved in a memory unit 7, so as to determine a number of motor steps, or a motor step frequency 611 622 when the motor steps are related to a time unit such as the minute or hour. The motor step frequencies 611, 622 respectively correspond to the activation frequencies of the first motor 61 and the second motor 62 in accordance with Newton's equation of motion 700 described hereinafter. FIG. 1B illustrates the different steps of converting the angular rotational velocity 111 of crown 11 into a number of motor steps, and the calculation parameters:

Step 4001 consists in determining an impulse frequency 401, used at the output of counter module 44 by the microcontroller of processing unit 5 for calculating the number of motor steps and deducing therefrom the motor step frequency 611 622. A preferred structure for sensor 4 used to carry out this step 4001 is detailed hereinafter with reference to the illustrations of FIGS. 2A and 2B:

During step 5000, a proportionality coefficient 701 is multiplied by impulse frequency 401 to determine a virtual torque value 401', which is supposed to be applied, according to the modelling selected within the scope of the invention, to minute hand 21 about the axis of rotation thereof.

Step 5001 is the main calculation step performed by the microcontroller. The purpose of the step is to determine the motor step frequency 611 of first motor 61 as a function of the impulse frequency 401, in order to deduce therefrom the actual angular velocity 211 of the minute hand. To do this, the microcontroller solves Newton's equation of motion 700, by modelling here the motion of minute hand 21 like that of a rotating system according to the fundamental principle of dynamics, which stipulates that the angular acceleration of a rotating body is proportional to the sum of the mechanical torques applied thereto. With the simulation parameters selected within the scope of the preferred embodiment of the invention, Newton's equation of motion reads as follows:

$$704*703'=401'-703'',$$

where, in the left part of the equation the coefficient 704 is the moment of inertia of the simulated rotating system (usually represented by the letter J in physics equations) and the reference 703' is the acceleration of the display means used in the invention, such as for example here the minute hand 21 about its axis of rotation. In order to give maximum inertia to the motion of minute hand 21, i.e. so that it continues to rotate as long as possible between activations of the control member, it should be noted that coefficient 704 of the moment of inertia of the simulated rotating system is preferably selected to be much greater than the real moment of inertia of minute hand 21, which gives it the behaviour of a more dense system, as though, for example, it were rotatably integral with a metal disc. In the right part of Newton's equation of motion 700 hereinbefore, the value 401' is a virtual mechanical torque applied to the rotating system which is simulated for minute hand 21. Virtual torque 401', which depends on impulse frequency 401 is different from zero during rotation of crown 11. Another virtual torque 703", proportional to the simulated angular velocity 703 of the display means, in this case that of minute hand 21, models fluid friction which gradually slows down the motion of minute hand 21. This mechanical torque is the only one applied when crown 11 is no longer being activated. Like virtual torque value 401', virtual torque value 703" is obtained by multiplying the simulated angular velocity 703 by a proportionality coefficient 702, called the fluid friction coefficient. The fluid friction modelling in this case gives Newton's equation of motion 700 the form of a differential equation for the simulated angular velocity 703 of hand 21, which is solved by the microcontroller. According to the preferred embodiment described, the solution to Newton's equation of motion 700 allows emulation of a fluid and continuous hand motion, since the angular velocity of the hand is determined as though it were a rotating system subject to a mechanical torque when the crown is activated, and a fluid slowing torque. According to the preferred embodiment described here, the input parameter selected for this equation is a virtual torque 401' proportional to the rotational velocity of crown 11 and, as output result, a simulated rotational velocity 703 of minute hand 21.

Simulated rotational velocity 703 then enables the number of motor steps per second to be proportionally deduced, i.e. motor step frequency 611. The actual angular velocity of minute hand 211 is mutually proportional to the motor step frequency 611 thus established. According to a preferred embodiment of the invention, each motor step causes a movement of hand 21 through an angular sector corresponding to an indication having a duration of less than one minute. To make the hand movement as fluid as possible, the angular value of the angular increment of each step is preferably equal to 2 degrees. In other words, each motor step rotates minute hand 21 through an angular value of one third of that corresponding to one minute. A finer resolution could also be envisaged but would require increased use of motor 61, which would have to increment more steps and would in that case accordingly use an increased amount of energy.

Step 50002 deduces the frequency value 622 of the second motor 622 according to the frequency value of first motor 611 found at the end of step 50001. The ratio of rotational velocities between minute hand 21 and hour hand 22 is 12 for a standard analogue display in which one complete revolution of minute hand 21 corresponds to a one hour advance of hour hand 22, i.e. one twelfth of the dial for an hour scale of 1 to 12. It is therefore relatively easy to deduce the value of frequency 622 of second motor 62 without having to perform an intrinsic calculation, or division operation, but simply by implementing, in motor control circuit 6, an order for second motor 62 to advance one step after each 12th step of first motor 61. Requirements in terms of calculation are thus minimised while providing an intuitive visual effect of coordinated movement by several display members, namely minute hand 21 and hour hand 22, during adjustment of said members. The subordination of this additional calculation step 5002 to the preceding calculation step 5001 in the preferred embodiment described hereinbefore, also enables the movement of the two hands 21, 22 to be coordinated simply.

The preferred embodiment forms the coupling between activation means 1, which are preferably mechanical, but which may also take the form for example of a capacitive sensor, such as a tactile screen, and display means 2 by means of a sensor module 4, which characterizes the motion of activation means 1, preferably a crown 11, as numeric values, namely a number of impulses. This step of determining an impulse frequency 4001 is a necessary digitization process for supplying an input parameter that can be handled by electronic circuit 31, which can then simulate the motion of the mechanical display means as though it were determined by applying a torque 401' proportional to impulse frequency 401. The actual movement of the hands is considered to be inertial since it corresponds to that of a rotating solid which, once crown 11 is no longer being activated, is only subjected to a fluid friction torque, proportional to the actual rotational velocity thereof, causing the hands to slow down gradually. According to the preferred embodiment described, this fluid friction torque 703" is however virtual and simulated by microcontroller 5 within Newton's equation of motion 700 hereinbefore. It is not, however, applied directly to minute hand 21, but to the simulated velocity of minute hand 703 which is also used to solve Newton's equation of motion 700.

One of the specificities of the modelling proposed relative to a "physical reality" is that the real angular velocity of the hands, and according to the preferred embodiment selected the angular velocity of minute hand 211, is necessarily limited because of the constraints of the system in terms of processing capacity. Indeed, the first and second motors 61, 62 can only implement a predetermined maximum number of steps per second, and there consequently still exists a maximum motor step frequency 611' after which no further acceleration is possible. The maximum motor step frequency 611' of first motor 61 controlling minute hand 21 is preferably between 200 and 1000 Hz, which corresponds to a maximum rotational velocity of minute hand 21 of between one and five revolutions per second when a complete revolution of the dial is 180 motor steps. It should be noted that whichever embodiment is selected for the invention involving the use of an electronic circuit 31, a maximum velocity for moving mechanical display means 2 will always have to be defined as a function of the processing capacity of motor control circuit 6.

Figure 2A:
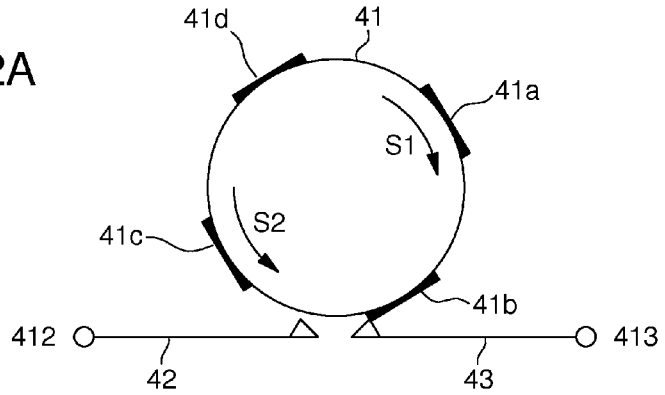
FIG. 2A illustrates a sensor structure according to a preferred embodiment of the invention.

FIG. 2A shows a preferred embodiment of sensor 4 according to the invention, which can relatively simply determine an impulse frequency 401 used by electronic circuit 31 for calculating the acceleration and/or deceleration values of mechanical display means 1, by solving Newton's equation of motion 700 applied to this input parameter. Sensor 4 is mounted on a stem 41 rotatably integral with crown 11 and which can be driven in rotation in two opposite directions 51 and S2. A plurality of electric contactors 41*a*, 41*b*, 41*c*, 41*d* are mounted at the periphery of stem 41. There are 4 contactors in the preferred embodiment, as illustrated in FIG. 2A. Sensor 4 further includes two electric contacts 42, 43 mounted on a fixed structure. At the terminals of the first contact 42, the value of an output signal 412 is measured, and at the terminals of the second contact 43, the value of an output signal 413 is measured, when a voltage is applied to the electric contactors 41*a*, 41*b*, 41*c*, 41*d*.

Figure 2B:
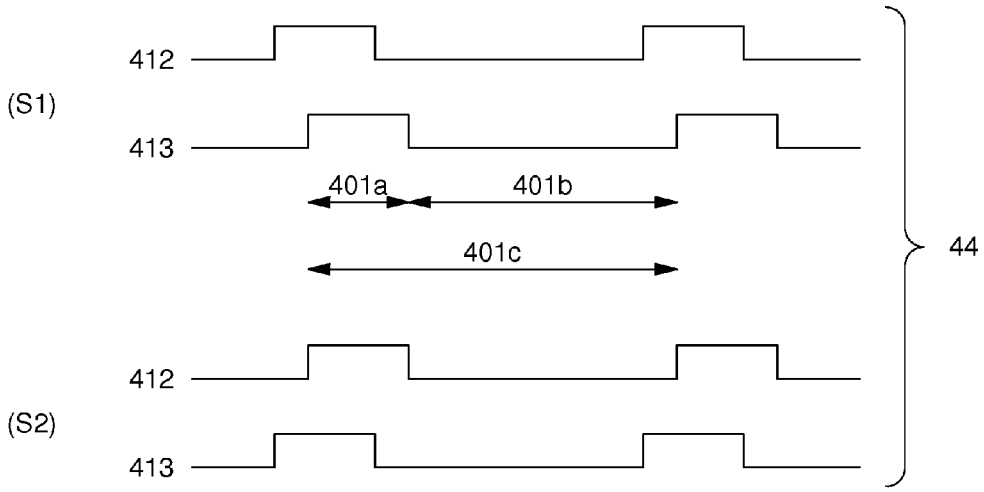
FIG. 2B shows the operation of the sensor according to the preferred embodiment illustrated in FIG. 2A.

FIG. 2B shows, in top part (a), the first and second signals 412 and 413 obtained during rotation of crown 11 in direction of rotation 51, which is the clockwise direction. The first period 401*a*, which is the duration during which each signal 412, 413 is positive, the second period 401*b* during which each signal 412, 413 is zero and the third total period 401*c*, which is the sum of the first and second periods 401*a*, 401*b*, are identical for each of first and second output signals 412, 413, which are simply temporally shifted by a value corresponding to the path of one of the electric contacts 41*a*, 41*b*, 41*c*, 41*d* from the first contact 42 to the second external contact 43. The diagram is reversed in bottom part (b) of the Figure, where crown 11 is rotated anticlockwise S2, and where the square of the first output signal 412 is formed before that of the second output signal 413. These signals 412, 413 and their periods 401*a*, 401*b*, 401*c* are then transmitted to counter module 44 to be converted into numeric values.

While it was established hereinbefore that the preferred embodiment of the invention using sensor 4 of FIG. 2A preferably includes, for practical reasons, a restricted number of contactors, the use of this type of contactor for determining the impulse frequency 401 applied to Newton's equation 700 has the further advantage of not requiring any fine resolution of sensor 4 to ensure correction fluidity, since the determined velocity solving this equation is always continuous even if the acceleration is not. Thus less fine resolution of the granularity of the torque values, proportional to impulse frequency 401, will not result in jerking the display means 2 forward, but will simply generate clearer accelerations following detection of each additional impulse. It is also possible to adjust proportionality coefficient 701 relative to the detected impulse frequency according to the sensitivity of the sensor.

It can also be envisaged, according to an alternative embodiment, to use one or several contactors associated with one or several push buttons (not shown) and to increment impulse frequency 401 upon each application of pressure to a first push button, and respectively decrement impulse frequency 401 upon each application of pressure on a second push button. According to this alternative embodiment, two sensors will thus be used, respectively dedicated to increasing and decreasing impulse frequency 401, which according to the modelling of the invention, means applying a mechanical torque in one direction or in the opposite direction to accelerate and decelerate respectively the motion of hands 21, 22.

Figure 3:
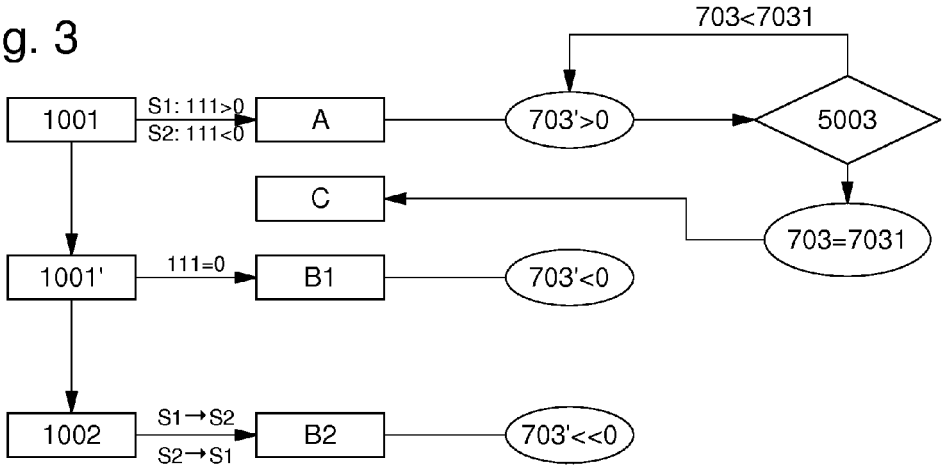
FIG. 3 shows a state diagram for the various sequences of adjustment operations according to a preferred embodiment of the invention.

FIG. 3 shows a state diagram for different sequences of time adjustment operations, using hands in accordance with a preferred embodiment of the invention, applied to a timepiece. Those skilled in the art will understand that it is, however, possible to adjust other types of parameters which are not necessarily time-related (i.e. any type of symbols) and that the hands could be replaced by other analogue display members.

Step 1001 is a first activation of the crown 11, which generates the movement of minute hand 21. When the crown is activated in a given direction of rotation, for example in direction 51, sensor 4 detects a "positive" number of impulses 401 corresponding to a positive angular velocity 111 for crown 11 and simulates the application of a torque, applied to the hand in the same direction. Thus the rotation of crown 11 in clockwise direction 51 moves minute hand 21 forward on the dial. A repeated rotation of crown 11 in the same direction 51 keeps the impulse frequency 401 positive during successive sampling periods used by counter module 44, and thus accelerates the motion of hand 21 still further in accordance with Newton's equation of motion 700, until a fluid and continuous movement is obtained, in which it is no longer possible to visually observe the hand jumping at each step. Since the motion of minute hand 21 cannot, however, exceed a maximum angular velocity, which is observed once maximum motor step frequency 611' is attained, the rotation of crown 11 no longer has any effect once this maximum velocity is reached. According to a preferred embodiment, a maximum simulated angular velocity 7031 is determined as a function of the maximum motor step frequency 611'. As soon as the algorithm solving Newton's equation reaches this maximum velocity limit, it saturates, i.e. stops increasing simulated angular velocity 703, even if the algorithm gave a higher value result.

The diagram of FIG. 3 illustrates comparison step 5003 performed by microcontroller 5 to determine whether the velocity is saturated, in which case simulated angular velocity 703 is limited to maximum value 7031 and angular acceleration 703' is zero for the sampling period in which the calculation was performed. The feedback loop starting from comparison step 5003 towards a positive acceleration value 703' indicates that no saturation has occurred, as long as the maximum simulated angular velocity 7031 has not been reached.

Step 1001 was described for the activation of crown 11 in the clockwise direction of rotation 51, preferably to advance minute hand 21 in the same direction. However, an arrangement is also possible wherein activation of crown 11 in the opposite direction S2, similarly rotates minute hand 21 and hour hand 22 in the opposite direction, with the number of impulses 401 being calculated in an identical manner for each sampling period, but the information as to the direction of rotation determined by sensor 4 allowing selection of the direction of rotation applied to the hands by the first and second motors 61, 62.

Moreover, the solution proposed here according to which the movement applied to the mechanical display means is the result of an acceleration which depends upon the velocity of the crown is very robust for a crown of low resolution. Moreover, the motion remains fluid, even if the user jerks the crown forward. If a user rotates the crown by successive jerks, the corrections continue between the jerks. This provides significant time saving if the mechanical display means are not very high performance. Thus, simultaneous adjustment of hour hand 22 and minute hand 21 in a totally mechanical approach, wherein the minute hand completes one revolution for each hour change, is made possible at an acceptable velocity for the user even for a relatively slow system. Indeed, to maintain this very intuitive approach for the user, a correction of several hours for electronic timepieces with an analogue display requires the minute hand to make a large number of motor steps, which may take much too long for the user to execute if the motors are not very high performance. The significant time saving provided by the invention due to the continuous motion of the hands between the periods of activation of crown 11 means that these adjustments can be performed simultaneously, independently of the efficiency of the electronic circuit and motors.

Whatever the direction of rotation S1 or S2 of crown 11, activation step 1001 consequently adjusts hour hand 22 and minute hand 21 simultaneously, which is particularly advantageous for electronic watches where each setting is generally adjusted sequentially for reasons of performance.

Step 1001' is a subordinate step to step 1001, or more generally any activation step, which it immediately follows. This is a step during which crown 11, or more generally control means 1, stops being activated. During this step, the modelling of the invention means that there is no longer any external torque applied to the system once the detected impulse frequency 401 is zero, which depends, amongst other things, on the sampling period chosen at the electronic interface of the sensor, formed here by counter module 44 for determining impulse frequency 401. As soon as value 401 becomes zero, angular acceleration 703' is determined only by the modelled fluid friction, namely according to Newton's equation 700:

$$703'=-703''/704$$

The solution to Newton's equation 700 determines the inertial slowing down of the display member, such as for example minute hand 21 in the embodiment previously described, since deceleration is only proportional to the simulated angular velocity 703. During this inertial slowing down, the system is in the first deceleration phase B1, illustrated in FIG. 3.

If, however, after having been rotated, for example in direction S1, crown 11 is rotated in the opposite direction S2 in an additional activation step 1002, the angular acceleration 703' is still negative, but deceleration B2, illustrated in FIG. 3, is more pronounced since the sign of virtual torque 401' becomes negative, acting with angular acceleration 703' to slow the system down more quickly.

The activation of crown 11 in the opposite direction further refines the adjustment by using additional activation step 1002, when the desired value is close, whereas the angular velocity is relatively high at that particular moment since the second deceleration phase B2, which is generated, is more pronounced than first deceleration phase B1, which only occurs during prolonged activation of crown 11.

As seen in FIG. 3, the first activation step 1001 is thus always followed by an acceleration phase A of mechanical display means 2, and first of all minute hand 21, for which the acceleration is the most noticeable. This acceleration phase A ends when motor control circuit 6 detects that a maximum frequency has been reached, in this case step frequency 611' of first motor 61, in which case a phase C follows, during which the simulated angular velocity 703 is limited to the maximum angular velocity value 7031. During this phase C, minute hand 21 is thus constant, limited by maximum step frequency 611' of first motor 61. Any additional activation of crown 11 in the same direction of rotation S1 thus has no impact on the real angular velocity 211 of the minute hand. However, these activations keep the real angular velocity 211 at this constant level preventing the angular acceleration value 703' from becoming negative after too long a period of inactivation, which, in the preferred embodiment described, corresponds to a sampling period, and which can be calibrated for example to a second. Moreover, the proportionality coefficients defining the moments applied to the system in Newton's equation of motion 700, namely proportionality coefficient 701 relative to impulse frequency 401 and fluid friction proportionality coefficient 702, may preferably be chosen, together with maximum motor step value 611' of first motor 61, so that the angular acceleration value 703 is always positive once at least one impulse 401 is detected per second, or respectively the value chosen for the above time lapse, so that the actual angular velocity 211 always remains constant if crown 11 is activated at least once per second, as soon as maximum angular velocity 21 has been reached.

It is clear thus from reading the foregoing that, whichever activation means, preferably mechanical means 1 and mechanical display means 2 are used within the scope of the invention, the acceleration phase A of display means 1 is followed most of the time by a phase C during which the velocity of movement of display means 2 is constant as soon as there is a large difference between the display value displayed when the adjustment is carried out, and the desired value to be reached. If the control means is not activated during a determined time period, the first deceleration phase B1 of display means 2 occurs after this prolonged inactivation, otherwise a second more pronounced deceleration phase B2 can be activated in an additional activation step 1002 of the control means, in the opposite direction to that used in initial activation step 1001. In the case of a crown 11, this is the opposite direction of rotation S2, if S1 was the first direction of rotation, and S1 if S2 was the first direction of rotation. The use of a second activation step 1002 depends upon the preferences of the user of the display device, in terms of the velocity of movement and on the time at which he wishes to perform a finer adjustment of the analogue display element(s).

The solution of coupling mechanical display means and control means according to the invention thus allows increased control throughout the adjustment operations with the possibility of accelerating and/or decelerating the movement of the mechanical display element(s) at any time. Further, the variations in velocity are much more gradual than in the prior art solutions where the velocity is directly deduced from the sensor values. Determination of an acceleration instead of a velocity from the magnitudes of a sensor makes the motion of the mechanical display elements fluid. Although the preferred solution described converts a physical quantity into a physical quantity of the same order, namely an angular velocity—that of crown 11—into another angular velocity—that of minute hand 21 and hour hand 22. It is however also possible to envisage replicating the coupling device 3 with any other type of mechanical display means 2 and any activation means 1, provided that an inertia effect is provided for the movement of the mechanical display means 2. In the case of timepieces, it is possible to favour generation of a rotating movement of display means 2 which are most frequently used for mechanical watches, whichever activation mode is used (rotation of a crown, pressure on a push button, moving a finger on a tactile screen, etc.). However, movements of linear indicators can also be envisaged, in which case the fundamental equation of motion will not relate a torque to an angular acceleration, but a force to a linear acceleration. Similarly, the slowing down of the inertial motion is no longer in this case caused by a torque modelling fluid friction, but by a friction force.

What is claimed is:

1. A coupling device for a timepiece between activation means and mechanical display means of a display mechanism, said coupling device being adapted to apply a variable velocity of motion to said mechanical display means in response to the activation of said activation means, wherein said coupling device calculates a simulated inertial motion of the mechanical display means, and then drives said mechanical display means accordingly such that deceleration of the display means is proportional to velocity of the display means once the activation means is no longer activated, wherein said mechanical display means includes at least one hand.

2. The coupling device according to claim 1, wherein said coupling device further includes at least one sensor module dedicated to said activation means and an electronic circuit for simulating and controlling an inertial motion of the mechanical display means, determined from a Newton equation of motion with fluid friction modeling.

3. The coupling device according to claim 2, wherein said coupling device further activates at least one motor driving said mechanical display means, said at least one motor also determining a maximum velocity of motion for said mechanical display means.

4. The coupling device according to claim 3, wherein said coupling device further simultaneously activates a plurality of motors, each dedicated to distinct mechanical display means.

5. The coupling device according to claim 3, wherein the acceleration and/or deceleration of said mechanical control means is calculated according to an impulse frequency detected by a sensor mounted on a stem of a crown.

6. The coupling device according to claim 5, wherein said activation means is a crown and said mechanical display means are hands, wherein the angular acceleration of at least one of said hands is calculated according to said impulse frequency and to a simulated angular velocity for said hand.

7. The coupling device according to claim 6, wherein each motor step indexes said hand through an angular sector corresponding to an indication with a duration of less than one minute.

8. The coupling device according to claim 6, wherein said activation means is a crown, wherein the activation of said crown in a first direction of rotation causes a first acceleration phase of said mechanical display means, whereas the activation of said crown in a second direction of rotation, opposite to said first direction of rotation, causes a second deceleration phase of said mechanical display means.

9. The coupling device according to claim 1, wherein said coupling device further kinematically connects said activation means, formed by at least one mechanical control member, to said mechanical display means.

10. A method for adjusting the display parameters for a timepiece visualised using mechanical display means, wherein said mechanical display means includes at least one hand and can be activated by activation means, said method including the following steps:

activating said activation means to apply a motion of variable velocity to said mechanical display means, a first phase of accelerating said mechanical display means;

a first inertial deceleration phase of said mechanical display means following inactivation of said activation means for a given period of time, said first inertial deceleration phase including calculating a simulated inertial motion of the display means and driving said mechanical display means accordingly such that deceleration of the display means is proportional to velocity of the display means once the activation means is no longer activated.

11. The method for adjusting display parameters according to claim 10, wherein the method includes an additional step of activating said mechanical control means to cause a second deceleration phase, which is more pronounced than said first inertial deceleration phase.

12. The method for adjusting display parameters according to claim 11, wherein the motion of said display means is determined by a Newton equation of motion.

13. The method for adjusting display parameters according to claim 12, wherein the method includes an additional phase during which the velocity of said display means is constant.

14. The method for adjusting display parameters according to claim 13, wherein said display means includes two distinct members which are simultaneously adjusted.

* * * * *